United States Patent [19]

Fluegel

[11] Patent Number: 4,909,354

[45] Date of Patent: Mar. 20, 1990

[54] SEGREGATED FLUID MANAGEMENT SYSTEM AND METHOD FOR INTEGRATED DRIVE GENERATORS

[75] Inventor: Theodore D. Fluegel, Waltham, Mass.

[73] Assignee: Sundstrand Corporation, Rockford, Ill.

[21] Appl. No.: 269,683

[22] Filed: Nov. 10, 1988

[51] Int. Cl.[4] ..... F01M 9/10; F16H 37/06; F16H 47/04

[52] U.S. Cl. ..... 184/6.0; 184/6.12; 184/6.13; 475/72; 475/151; 475/159; 475/161

[58] Field of Search ..... 74/967, 686, 687; 184/6, 6.13, 6.12

[56] References Cited

U.S. PATENT DOCUMENTS

| | | | |
|---|---|---|---|
| 3,576,143 | 4/1971 | Baits | 74/687 |
| 3,688,872 | 9/1972 | Wagner | 184/6.28 |
| 3,786,696 | 1/1974 | Aleem | 74/687 |
| 4,046,029 | 9/1977 | Sugden | 74/687 |
| 4,252,035 | 2/1981 | Cordner et al. | 74/687 |
| 4,315,442 | 2/1982 | Cordner | 74/687 |
| 4,713,982 | 12/1987 | Fluegel et al. | 74/686 |

*Primary Examiner*—Allen M. Ostrager
*Attorney, Agent, or Firm*—Antonelli, Terry & Wands

[57] ABSTRACT

A segregated fluid management system and method is provided for a SDG or IDG system. There is a full case hydraulics (24), a gear case section (19) and a generator section (25). The full case hydraulics section (24) operates completely full of oil. A charge pump (34) draws from the full case (33) inside this section (24) and discharges oil from the case (33) to the pump and motor (26), the servo valve (29), the control piston (30) and the charge relief valve (31). The gear case section (19) is operated as a dry sump by a scavenge pump (17) which keeps the gear case cavity from accumulating an appreciable amount of oil. The scavenge pump (17) removes oil from the gear case section (19) and routes it through a filter (35) to the full case hydaulics section (24). The generator section (25) is conduction cooled and has a pitot pump (40) arranged in an air gap (39) between the generator rotor (37) and the stator (38). Oil is evacuated out of the generator section (25) through both the pitot pump (40) and a stator discharge (41) associated with the sump (18) in the gear case section (19).

19 Claims, 1 Drawing Sheet

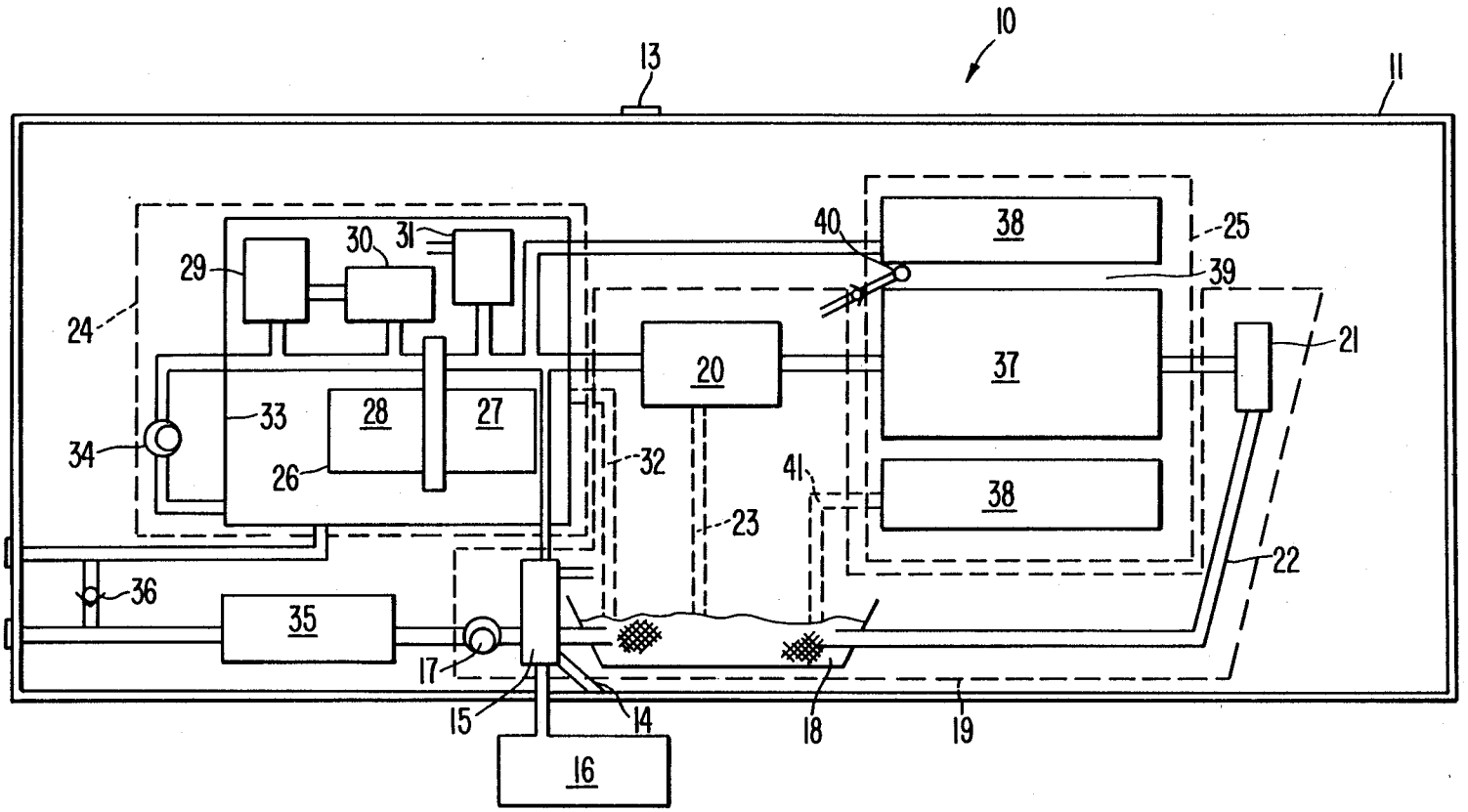
10
11
13
14
15
16
17
18
19
20
21
22
23
24
25
26
27
28
29
30
31
32
33
34
35
36
37
38
38
39
40
41

SEGREGATED FLUID MANAGEMENT SYSTEM AND METHOD FOR INTEGRATED DRIVE GENERATORS

TECHNICAL FIELD

The present invention relates to a system and method for managing fluid in a starter-drive generator (SDG) and integrated drive generator (IDG) systems and, more particularly, to a system and method which manages fluid by segregation among various sections of a system to prevent overfilling and catastrophic failure.

BACKGROUND ART

Integrated drive-generator (IDG) systems and starter-drive-generator (SDG) systems are well known as can be seen, by way of example, in U.S. Pat. Nos. 3,576,143; 3,786,696; 4,046,029; 4,252,035; and 4,315,442. In all such conventional systems, it is common to supply lubricating fluid to various sections such as the generator, the gear case and the full case hydraulic section by filling the various system component sections without recognition of the fact that various sections have different oil needs. Thus, by filling one section to sufficient capacity, it is possible that other sections will be overfilled when servicing because of the different oil lubrication and cooling schemes.

The management of fluid allocation and servicing levels becomes even more difficult because of the demand for lighter weight and more efficient aircraft engine accessories. For example, with state-of-the-art IDG systems, typically there are provided right and left pumps and motors, each with variable and fixed displacement hydraulic units, with which are associated a planetary differential and a conduction-cooled generator. These systems can encounter catastrophic failure as a result of overfilling during servicing, high heat rejection and inconsistencies in the filling procedure which result from misallocation and servicing levels of the fluid. No consideration has been given in such systems to the desirability of distinct fluid management for the major components of these systems.

DISCLOSURE OF THE INVENTION

The object of the present invention is to overcome the problems of fluid allocation and servicing levels in SDG/IDG systems.

More specifically, the aforementioned problems have been solved with the recognition of the need to provide each of the three primary IDG sections, e.g. the generator, the gear case and the full case hydraulics, with a different oil lubrication and cooling scheme.

The fluid management system in accordance with the present invention provides a conduction cooled generator so that there is no oil bath in the generator section. If oil leaks into that section because of, for example, a failed shaft seal or "O" ring, the oil can be evacuated out of the generator section and into the gear case section by a rotating cylinder pitot pump of known construction.

A further feature of the present invention is the provision of a charge pump in the full case hydraulics section which is designed to operate completely filled with oil. If the amount of oil fed into the hydraulics section exceeds the available volume, oil will exit through a bleed hole into the gear case section.

To further achieve the objects of the present invention, the gear section is operated as a dry sump in which a standard scavenge pump prevents the cavity of the section from accumulating an appreciable amount of oil.

With the foregoing arrangement, the charge pump in the full case hydraulics section draws oil from the full case section and supplies that oil to the hydraulics section, the differential gear section and the generator section for lubrication and cooling, while the scavenge pump removes oil from the gear section and routes it to the full case hydraulics section via a filter and cooler.

As a result of the foregoing arrangement, the system case can be filled until oil flows out from the overflow port. Therefore, the person servicing the system can be certain that all cavities and cores are full except the generator air gap and an accumulator in the system. The accumulator will be filled with oil when the unit is run up to operating speed. When oil is displaced into the accumulator, most of the oil in the gear case will be vacated.

With the segregation of fluid, there can be an increase in system efficiency because the differential gear and generator air gap will have less exposure to the oil. This results in reduced churning losses.

Another advantage of the invention is that there will not be overfilling of the system. This reduces the possibility of catastrophic failure and improves the serviceability of the system.

Yet another advantage of the invention resides in improved cold starting. In other words, with the elimination of oil in the generator air gap, high drag torque during cold starts can be minimized due to the absence of viscous oil in the air gap.

A further advantage of the present invention is that the accumulator in the system can automatically accommodate a reduced charge pressure by releasing more oil into the charge circuit. When this occurs, additional oil is accommodated in the gear case and makes scavenging easier and thus improves attitude ability of the system.

Still another advantage of the present invention is that the accumulator obviates the need for an inversion pump, and the full case hydraulics section acts as a deaerating dwell tank with air exiting through a bleed hole which obviates the need for a deaerator. Consequently, the number of system parts can be reduced with utilization of the present invention.

The present invention also addresses the problem of high heat rejection and too many restrictions and inconsistencies in the filling procedure which are currently associated with conventional IDG systems.

BRIEF DESCRIPTION OF THE DRAWING

These and other features, objects and advantages of the present invention will become more apparent from the following of the best mode when taken in conjunction with the accompanying drawing which shows in a single figure a schematic representation of the segregated fluid management system which utilizes the concepts and method of the present invention.

BEST MODE

Referring now to the sole figure, there is shown an IDG system designated generally by the numeral 10. This system employs a number of elements which are conventional in IDG systems. Consequently, these need only be shown schematically since these elements are well known in the art.

Specifically, the system is provided with a housing 11 which contains the various sections of the IDG system.

The housing 11 is designed to be completely filled except for the generator air gap with lubricating and cooling fluid. To prevent overfilling and overpressurization of the housing 11, an overflow port 13 is provided at the top of the case. A fill port 14 is shown at the bottom of the housing 11. The fill port 14 communicates with a fill valve 15. An accumulator 16 also communicates with the fill valve 15 which also communicates with a scavenge pump 17 and a sump 18.

The fill valve 15, the pump 17 and the sump 18 are part of the gear case section 19 which for ease of illustration and understanding of the present invention is shown schematically by way of long dash lines 19 in order to avoid the need for showing conventional partitioning structure which would not be essential to an understanding of the present invention. The gear case section 19 also includes the differential gearing 20 and the input shaft assembly and generator bearing 21, the latter of which has a seal and bearing drain 22 for draining fluid to the sump 18. A drain 23 is provided for draining fluid from the differential gear 20 to the sump 18.

In operative adjacent relationship to the gear case section 19 are the full case hydraulics section 24 and the generator section 25, both of which are also shown in dashed lines for ease of understanding of the present invention. The full case hydraulics section 24 contains at least one pump and motor 26 having a fixed displacement hydraulic unit 27 and a variable displacement hydraulic unit 28, the fixed displacement hydraulic unit 27 being operatively connected to the differential gears 20 in a known manner so as to drive the differential gears 20 such as a planetary differential gear arrangement.

Also in the full case hydraulics section 24 and associated with the pump and motor 26 are the servo valve 29, the control piston 30 and a charge relief valve 31. A bleed hole 32 is provided for the full case hydraulics section 24 in order to drain excess full case fluid to the sump 18. Within the full case hydraulics section is the case 33 which contains the pump and motor 26, the servo valve 29, the control piston 30 and the charge relief valve 31. It is intended that the case 33 is full of fluid and any leakage of fluid from the case 33 passes through the bleed hole 32 to the sump 18.

Outside of the case 33 but within the full case hydraulics section 24 is arranged in charge pump 34 connected at the intake side to the bottom of the case 33 and at the discharge side to the servo valve 29, the control piston 30, the charge relief valve 31 and to the pump and motor 26. In addition, the line communicating the charge pump 34 with the parts 29, 30 and 31 also communicates with the differential 20, the generator stator 38, the generator rotor 37, and with the accumulator 16 through the fill valve 15. The scavenge pump 17 in the gear case section 19 is connected to the bottom of the case 33 in the full case hydraulics section 24 by means of an oil circuit which includes a filter 35 and an external circuit bypass valve 36.

The generator section 25 contains the generator rotor 37 and the stator 38. Along the side of the air gap 39 between the rotor 37 and the stator 38 is provided a pitot pump 40 of known construction. A stator discharges into the sump 18 from the cooling passage in the generator stator 38.

In servicing and operating the system in accordance with the method of the present invention, fluid such as oil will be filled into the housing 11 through the fill port 14 at the bottom of that case until it flows out through the overflow port 13 at the top of the case. This overflow will signal the service technician that all cavities and cores of the case, including the gear section 19, are filled with the exception of the air gap 39 between the generator rotor 37 and stator 38. Also, the accumulator 16 initially will not be filled with fluid until the system begins to operate. When the system begins to operate and is run to its desired operating speed, pressure will build up in the system and the accumulator 16 will be filled with the oil. By virtue of the accumulator being filled with oil, most of the oil in the gear case section 19 will be vacated so as to operate as a dry sump with the scavenge pump 17 keeping the cavity of the gear case section 19 from accumulating an undesired amount of oil therein. The scavenge pump 17 removes oil from the gear case section 19 and routes it through the filter 35 and a cooler (not shown) to the full case hydraulics section 24 by means of the oil circuit which includes the external circuit bypass valve 36.

Insofar as the generator section 25 is concerned, it is desired that the generator be conduction cooled with no oil bath in the section. If, for some reason such as a failed shaft seal or a failed O-ring, oil does leak into the generator section 25, it will be evacuated therefrom into the gear case section 19 by means of the pitot pump 40 which evacuates oil from the air gap 39.

The full case hydraulics section 24 will operate with the case 33 substantially full. In the event that conditions force the amount of oil to exceed the available volume in the case 33, the excess oil will be drained through a bleed hole into the sump 18 by means of the drain 32.

While a presently preferred embodiment in accordance with the present invention, has been shown and described, it is to be understood that the same is susceptible of numerous changes and modifications within the scope of the invention. Therefore, I do not wish to be limited to the details shown and described herein but intend to cover all such changes and modifications as are encompassed by the scope of the appended claims.

I claim:

1. A management system for fluid used in drive-generator systems including a generator section, a gear case section and a full case hydraulics section, comprising first means for maintaining a desired amount of fluid in the generator section, second means for maintaining a desired amount of fluid in the gear case section, and third means for maintaining a desired amount of fluid in the full case hydraulics section, wherein said first, second and third means constitute separate fluid environments.

2. A management system according to claim 1, wherein the generator section has a stator and rotor defining an air path therebetween, and said first means includes a pitot pump operatively arranged to drain fluid from the air path.

3. A management system according to claim 2, wherein the generator section is conduction cooled.

4. A management system according to claim 1, wherein a sump is associated with the gear case section through a drain means.

5. A management system according to claim 4, wherein the generator section is conduction cooled.

6. A management system according to claim 5, wherein said first means includes discharge means between the stator and the sump.

7. A management system according to claim 1, wherein an accumulator is operatively associated with the scavenge pump circuit.

8. A management system according to claim 7, wherein the accumulator is operatively associated with the full case hydraulics section and the generator section.

9. A management system according to claim 8, wherein the full case hydraulics section includes a charge pump operatively connected to the gear case section and generator section on its discharge side and to a case filled with fluid on its intake side.

10. A management system according to claim 9, wherein the generator section has a stator and rotor defining an air path therebetween, and said first means includes a pitot pump operatively arranged to drain fluid from the air path.

11. A management system according to claim 10, wherein said second means includes the drain means between a sump and the gear case section.

12. A management system according to claim 11, wherein said first means includes the discharge means between the stator and the sump.

13. A management system according to claim 12, wherein said third means includes the drain means between the case filled with fluid in the full case hydraulics section and the sump.

14. A management system according to claim 13 wherein the pitot pump is arranged to drain fluid to the gear case section.

15. A method for managing fluid in a drive-generator system which includes a generator section with a rotor and stator, a gear case section with differential gearing therein, and a full case hydraulics section with a pump and motor therein operatively associated with the differential gearing and generator rotor, comprising the steps of initially filling to full with fluid the gear case section and the full case hydraulics section;

commencing operation of the system to run the pump and motor, the differential gearing and the generator;

vacating most of the fluid from the gear case section to an accumulator and maintaining the gear case section as substantially a dry sump;

pumping fluid from an air gap between the generator rotor and stator to the gear case section and discharging fluid from the stator to a sump in the gear case section; and maintaining the full cause hydraulics section full of fluid to the extent of available volume.

16. A method according to claim 15, wherein a pitot tube is provided to pump the fluid from the air gap.

17. A method according to claim 15, wherein excess fluid in the full case hydraulics section is drained to the sump.

18. A method according to claim 15, including the further step of scavenging fluid from the gear section and providing the scavenged fluid to the full case hydraulics section.

19. A method according to claim 18, wherein excess fluid in the full case hydraulics section is drained to the sump.

* * * * *